US009359576B2

(12) United States Patent
Yoshida

(10) Patent No.: US 9,359,576 B2
(45) Date of Patent: Jun. 7, 2016

(54) LUBRICATING OIL COMPOSITION FOR INTERNAL COMBUSTION ENGINE

(71) Applicant: JX NIPPON OIL & ENERGY CORPORATION, Tokyo (JP)

(72) Inventor: Satoru Yoshida, Yokohama (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 7 days.

(21) Appl. No.: 14/388,119

(22) PCT Filed: Oct. 5, 2012

(86) PCT No.: PCT/JP2012/006434

§ 371 (c)(1),
(2) Date: Sep. 25, 2014

(87) PCT Pub. No.: WO2013/145037

PCT Pub. Date: Oct. 3, 2013

(65) Prior Publication Data

US 2015/0045271 A1 Feb. 12, 2015

(30) Foreign Application Priority Data

Mar. 26, 2012 (JP) ..... 2012-069000

(51) Int. Cl.

| | |
|---|---|
| ***C10M 163/00*** | (2006.01) |
| ***C10M 169/04*** | (2006.01) |
| ***C10M 141/08*** | (2006.01) |

(52) U.S. Cl.

CPC ..... *C10M 141/08* (2013.01); *C10M 169/042* (2013.01); *C10M 169/045* (2013.01); *C10M 2203/1006* (2013.01); *C10M 2207/026* (2013.01); *C10M 2207/262* (2013.01); *C10M 2209/084* (2013.01); *C10M 2215/064* (2013.01); *C10M 2215/086* (2013.01); *C10M 2215/28* (2013.01); *C10M 2219/046* (2013.01); *C10M 2219/068* (2013.01); *C10M 2223/045* (2013.01); *C10M 2227/066* (2013.01); *C10N 2220/022* (2013.01); *C10N 2230/02* (2013.01); *C10N 2230/10* (2013.01); *C10N 2230/54* (2013.01); *C10N 2240/10* (2013.01)

(58) Field of Classification Search

CPC ..... C10M 2219/068; C10M 2219/044
USPC ..... 508/364, 409
See application file for complete search history.

(56) References Cited

U.S. PATENT DOCUMENTS

| | | | | |
|---|---|---|---|---|
| 5,744,430 | A | 4/1998 | Inoue et al. | |
| 6,140,282 | A * | 10/2000 | Cartwright et al. | 508/398 |
| 2009/0163392 | A1 * | 6/2009 | Boffa et al. | 508/161 |

FOREIGN PATENT DOCUMENTS

| | | | |
|---|---|---|---|
| CN | 1510116 | A | 7/2004 |
| EP | 2 009 084 | A1 | 12/2008 |
| JP | A-6-306384 | | 11/1994 |
| JP | A-8-302378 | | 11/1996 |
| JP | H11-80771 | A | 3/1999 |
| JP | A-2001-279287 | | 10/2001 |
| JP | A-2002-129182 | | 5/2002 |
| JP | A-2011-132341 | | 7/2011 |
| WO | 2012/026399 | A1 | 3/2012 |

OTHER PUBLICATIONS

International Search Report issued in International Patent Application No. PCT/JP2012/006434 mailed Nov. 20, 2012.
Oct. 29, 2015 extended European Search Report issued in European Application No. 12872857.3.
Sep. 25, 2015 Office Action issued in Chinese Application No. 201280073468.2.

* cited by examiner

*Primary Examiner* — Vishal Vasisth
(74) *Attorney, Agent, or Firm* — Oliff PLC

(57) ABSTRACT

A lubricating oil composition for an internal combustion engine containing a mixed base oil (AB) including a mixture of a base oil (A) being a mineral oil and/or a synthetic oil with a kinematic viscosity at 100° C. of not more than 3.5 $mm^2/s$ and a base oil (B) being a mineral oil and/or a synthetic oil with a kinematic viscosity at 100° C. of more than 3.5 $mm^2/s$, wherein the ratio of the base oil (A) to the entire base oil is not more than 40 mass %, a calcium salicylate-based detergent (C) in 0.05 mass % to 0.5 mass % as a calcium amount based on the total amount of the composition, and a calcium sulfonate-based detergent (D) in 0.002 mass % to 0.2 mass % as a calcium amount based on the total amount of the composition.

12 Claims, No Drawings

LUBRICATING OIL COMPOSITION FOR INTERNAL COMBUSTION ENGINE

This application is a 371 of PCT/JP2012/006434, filed Oct. 5, 2012.

TECHNICAL FIELD

This invention relates to a lubricating oil composition for an internal combustion engine, more specifically to a lubricating oil composition for an internal combustion engine which uses a high performance base oil and a certain metal-based detergent and is excellent in fuel saving property and heat resistance property.

BACKGROUND ART

Conventionally, in internal combustion engines, transmissions and other mechanical devices, a lubricating oil has been used for smoothing their functions. Particularly, a lubricating oil composition for internal combustion engines (engine oil) requires a higher performance along with a higher performance and higher output of internal combustion engines, more severe driving conditions, and the like. Therefore, in order to meet such required performances, various additives such as anti-wear agent, metal-based detergent, ashless dispersant and anti-oxidizing agent have been formulated in a conventional lubricating oil composition for internal combustion engines (e.g., see Patent Documents 1 to 3 below). Moreover, in recent years, as the fuel saving performance required for lubricating oils is getting increasingly higher, application of high viscosity index base oils, application of various friction adjusting agents, and the like have been considered (e.g., see Patent Document 4 below).

PRIOR ART DOCUMENTS

Patent Documents

Patent Document 1: JP-A-2001-279287
Patent Document 2: JP-A-2002-129182
Patent Document 3: JP-A-H08-302378
Patent Document 4: JP-A-H06-306384

SUMMARY OF INVENTION

Technical Problem

Although in order to improve the fuel saving property of lubricating oils, a lowered viscosity has been attempted, the size has been miniaturized and the output has been increased particularly for internal combustion engines as described above, so the burden on lubricating oils is increasing more and more. Moreover, as a method of miniaturizing the size and increasing the output, a turbocharger has been installed. In lubrication particularly of turbochargers, since the temperature gets higher, higher heat resistance property is required. On the other hand, since the viscosity of lubricating oils has been lowered, and the evaporation property of lubricating oils has been increased, the correspondence to the lubrication property and heat resistance property at a high temperature has been required.

The invention, which has been developed in consideration of such circumstances, has the object to provide a lubricating oil composition excellent in fuel saving property and heat resistance property by using a high performance base oil with a high purity and also with a high viscosity index as a base oil, and using a certain metal-based detergent.

Solution to Problem

The inventors have, as a result of devoted studies for solving the above problems, found a lubricating oil composition excellent in fuel saving property and heat resistance property by adding a certain metal-based detergent to a certain mixed base oil, and completed the invention.

Thus, a lubricating oil composition for an internal combustion engine of the invention is characterized by containing:

a mixed base oil (AB) comprising a mixture of a base oil (A) being a mineral oil and/or a synthetic oil with a kinematic viscosity at 100° C. of not more than 3.5 $mm^2/s$ and a base oil (B) being a mineral oil and/or a synthetic oil with a kinematic viscosity at 100° C. of more than 3.5 $mm^2/s$, wherein the ratio of the base oil (A) to the entire base oil is not more than 40 mass %;

a calcium salicylate-based detergent (C) in 0.05 mass % to 0.5 mass % as a calcium amount based on the total amount of the composition; and a calcium sulfonate-based detergent (D) in 0.002 mass % to 0.2 mass % as a calcium amount based on the total amount of the composition.

In a preferred example of the lubricating oil composition for an internal combustion engine of the invention, the kinematic viscosity at 100° C. of the mixed base oil (AB) comprising the base oil (A) and the base oil (B) is 3.5 to 3.9 $mm^2/s$.

In another preferred example of the lubricating oil composition for an internal combustion engine of the invention, the base number of the calcium salicylate-based detergent (C) is 100 to 350 mg KOH/g.

In another preferred example of the lubricating oil composition for an internal combustion engine of the invention, the base number of the calcium sulfonate-based detergent (D) is 5 to 150 mg KOH/g.

Moreover, the lubricating oil composition for an internal combustion engine of the invention is preferable to further contain an organic molybdenum compound (E) in not less than 0.02 mass % as a molybdenum amount based on the total amount of the composition.

Advantageous Effect of Invention

According to the invention, a lubricating oil composition for an internal combustion engine excellent in fuel saving property and heat resistance property can be provided.

DESCRIPTION OF EMBODIMENTS

The invention will be described in detail below. The base oil of the lubricating oil composition for the internal combustion engine of the invention is a mixed base oil (AB) comprising a mixture of a base oil (A) being a mineral oil and/or a synthetic oil with a kinematic viscosity at 100° C. of not more than 3.5 $mm^2/s$ and a base oil (B) being a mineral oil and/or a synthetic oil with a kinematic viscosity at 100° C. of more than 3.5 $mm^2/s$, wherein the ratio of the base oil (A) to the entire base oil is not more than 40 mass %.

As the base oil of the lubricating oil composition for the internal combustion engine of the invention, specifically, among paraffin-based mineral oils, or normal paraffin-based base oils, isoparaffin-based base oil and the like which are formed by obtaining a lubricating oil fraction from a crude oil through atmospheric distillation and/or vacuum distillation, and refining it in one kind alone or two or more kinds in combination of refining treatments such as solvent deasphalting, solvent extraction, hydrogenolysis, solvent dewaxing, catalytic dewaxing, hydrogenation refining, sulfuric acid cleaning and clay treatment, a base oil meeting the above conditions for the kinematic viscosity at 100° C. can be used.

A preferred example of the base oil of the lubricating oil composition for the internal combustion engine of the invention includes a base oil formed by using base oils (1) to (8) shown below as raw materials, and refining this raw material oil and/or a lubricating oil fraction collected from this raw material oil in a determined refining method to collect a lubricating oil fraction.

Base oil (1): a distillate of a paraffin-based crude oil and/or a mixture based crude oil through atmospheric distillation.

Base oil (2): a distillate of an atmospheric distillation residue oil of a paraffin-based crude oil and/or a mixture based crude oil through vacuum distillation (WVGO).

Base oil (3): a wax obtained through a lubricating oil dewaxing process (slack wax, etc.) and/or a synthetic wax obtained through a gas-to-liquid (GTL) process and the like (Fisher Tropsch wax, GTL wax, etc.).

Base oil (4): one kind or a mixed oil of two or more kinds selected from the above base oils (1) to (3) and/or a mild hydrocracking treated oil of the mixed oil.

Base oil (5): a mixed oil of two or more kinds selected from the above base oils (1) to (4).

Base oil (6): a deasphalted oil of the above oil (1), (2), (3), (4) or (5) (DAO).

Base oil (7): a hydrocracking treated oil of the above oil (6).

Base oil (8): a mixed oil of two or more kinds selected from the above oils (1) to (7).

Moreover, as the above predetermined refining method, hydrogenation refining such as hydrogenolysis and hydrogenation finishing; solvent refining such as furfural solvent extraction; dewaxing such as solvent dewaxing and catalytic dewaxing; clay refining such as with acid clay and activated clay; chemical (acidic or alkali) cleaning such as sulfuric acid cleaning and caustic soda cleaning, and the like are preferable. In the invention, one kind alone, or two or more kinds in combination of these refining methods may be conducted. Also, when two or more kinds of refining methods are combined, their order is not particularly limited, and can be selected accordingly.

Furthermore, as the base oil of the lubricating oil composition for the internal combustion engine of the invention, the following base oil (9) or (10) obtained by conducting a predetermined treatment to a base oil selected from the above base oils (1) to (8) or a lubricating oil fraction collected from the base oil is particularly preferable.

Base oil (9): a hydrogenolyzed mineral oil obtained by hydrogenolyzing a base oil selected from the above base oils (1) to (8) or a lubricating oil fraction collected from the base oil, and subjecting its product or a lubricating oil fraction collected from the product through distillation and the like to a dewaxing treatment such as solvent dewaxing and catalytic dewaxing, or conducting distillation after the dewaxing treatment.

Base oil (10): a hydroisomerized mineral oil obtained by hydroisomerizing a base oil selected from the above base oils (1) to (8) or a lubricating oil fraction collected from the base oil, and subjecting its product or a lubricating oil fraction collected from the product through distillation and the like to a dewaxing treatment such as solvent dewaxing and catalytic dewaxing, or conducting distillation after the dewaxing treatment.

It should be noted that as the above dewaxing, catalytic dewaxing is the most preferable. Also, upon obtaining the above base oil (9) or base oil (10), in a convenient step, a solvent refining treatment and/or hydrogenation finishing treatment process may further be provided, if necessary.

Although the catalyst used in the above hydrogenolysis and hydroisomerization is not particularly limited, a hydrogenolysis catalyst comprising a composite oxide with decomposition activity (e.g., silica-alumina, alumina-boria, silica-zirconia) or one or more kinds of the composite oxide combined and bound with a binder as a carrier and a carried metal with hydrogenation capability (e.g., one or more kinds of periodic table Group VIa metals, Group VIII metals, etc.), or a hydroisomerization catalyst comprising a carrier including zeolite (e.g., ZSM-5, zeolite beta, SAPO-11, etc.) and a carried metal with hydrogenation capability including at least one or more kinds of Group VIII metals is preferably used. Moreover, a hydrogenolysis catalyst and a hydroisomerization catalyst may be used in combination through lamination, mixture, or the like.

In the lubricating oil composition for the internal combustion engine of the invention, the base oil comprises a mixture of a base oil (A) being a mineral oil and/or a synthetic oil with a kinematic viscosity at 100° C. of not more than 3.5 $mm^2/s$ and a base oil (B) being a mineral oil and/or a synthetic oil with a kinematic viscosity at 100° C. of more than 3.5 $mm^2/s$. As the base oil (A) and the base oil (B), it is preferable to fractionate a lubricant base oil with a kinematic viscosity at 100° C. within the following ranges through distillation and the like to use.

Base oil (A): a lubricant base oil with a kinematic viscosity at 100° C. of preferably 1.5 to 3.5 $mm^2/s$, further preferably 2.0 to 3.5 $mm^2/s$, further more preferably 2.5 to 3.5 $mm^2/s$, particularly preferably 3.0 to 3.5 $mm^2/s$.

Base oil (B): a lubricant base oil with a kinematic viscosity at 100° C. of preferably more than 3.5 $mm^2/s$ less than 4.5 $mm^2/s$, more preferably not less than 3.8 $mm^2/s$, and also more preferably not more than 4.3 $mm^2/s$.

The viscosity index of the above base oil (A) is preferably 105 to 135, more preferably not less than 110, and also more preferably not more than 130. With the viscosity index of the base oil (A) of less than 105, heat resistance property is poor, while with that of more than 135, low temperature viscosity property deteriorates.

Also, the viscosity index of the above base oil (B) is preferably not less than 115, more preferably not less than 120, further more preferably not less than 125, particularly preferably not less than 130. Also, the viscosity index of the above base oil (B) is preferably not more than 160, more preferably not more than 150. With the viscosity index of the base oil (B) of less than 115, heat resistance property is poor, while with that of more than 160, low temperature viscosity property deteriorates.

In the base oil of the lubricating oil composition for the internal combustion engine of the invention, the mixing ratio between the base oil (A) and the base oil (B) is that the base oil (A) is not more than 40 mass %, preferably not more than 35 mass %, more preferably not more than 30 mass %. Also, the ratio of the base oil (A) to the entire base oil is preferably not less than 5 mass %, further preferably not less than 10 mass %, further more preferably not less than 15 mass %, particularly preferably 20 mass %. With the ratio of the base oil (A) to the entire base oil of more than 40 mass %, evaporation property increases, and heat resistance property decreases. Also, with the ratio of the base oil (A) to the entire base oil of less than 5 mass %, the viscosity of the base oil increases, and sufficient fuel saving property may not be ensured.

In the lubricating oil composition for the internal combustion engine of the invention, the kinematic viscosity at 100° C. of the mixed base oil (AB) formed by mixing the base oil (A) and the base oil (B) is preferably 3.5 to 3.9 $mm^2/s$. With the kinematic viscosity at 100° C. of the mixed base oil (AB) of less than 3.5 $mm^2/s$, heat resistance property may be insufficient, while with that of more than 3.9 $mm^2/s$, sufficient fuel saving property may not be obtained.

In the lubricating oil composition for the internal combustion engine of the invention, the viscosity index of the mixed base oil (AB) formed by mixing the base oil (A) and the base oil (B) is preferably not less than 120, more preferably not less than 125, further more preferably not less than 130, most preferably not less than 135. On the other hand, the viscosity index of the mixed base oil (AB) is preferably not more than 160. With the viscosity index of the mixed base oil (AB) of less than 120, not only that viscosity-temperature property, heat/oxidation stability and volatilization preventing property deteriorate, but also that fuel saving property may not be sufficiently obtained. Also, with the viscosity index of the mixed base oil (AB) of more than 160, low temperature viscosity property tends to decrease. It should be noted that the viscosity index herein refers to a viscosity index measured according to JIS K 2283-1993.

Moreover, regarding the pour point of the base oil for use in the lubricating oil composition for the internal combustion engine of the invention, for example, the pour point of the above base oil (A) is, depending on the viscosity grade of the base oil, preferably not more than −20° C., further preferably not more than −25° C., further more preferably not more than −30° C. Also, the pour point of the base oil (B) is preferably not more than −10° C., further preferably not more than −15° C., further more preferably not more than −17.5° C. With the pour point of more than −10° C., the low temperature flow property of the entire lubricating oil using the base oil tends to decrease. It should be noted that the pour point herein refers to a pour point measured according to JIS K 2269-1987.

Moreover, the sulfur content of the base oil for use in the lubricating oil composition for the internal combustion engine of the invention is, in terms of further improvement of heat/oxidation stability and low sulfurization, preferably not more than ppm by mass, further preferably not more than 50 ppm by mass, further more preferably not more than 10 ppm by mass, particularly preferably not more than 5 ppm by mass.

Moreover, although the nitrogen content of the base oil for use in the lubricating oil composition for the internal combustion engine of the invention is not particularly limited, it is preferably not more than 7 ppm by mass, further preferably not more than 5 ppm by mass, further more preferably not more than 3 ppm by mass. With the nitrogen content of the base oil of more than 7 ppm by mass, heat/oxidation stability tends to decrease. It should be noted that the nitrogen content herein refers to a nitrogen content measured according to JIS K 2609-1990.

Moreover, the % $C_P$ of the base oil for use in the lubricating oil composition for the internal combustion engine of the invention is preferably not less than 70, and particularly for the base oil (B), it is preferably 80 to 99, further preferably 85 to 95, further more preferably 87 to 94, particularly preferably 90 to 94. With the % $C_P$ of the base oil of less than 70, viscosity-temperature property, heat/oxidation stability and friction property tend to decrease, and further when an additive is formulated to the base oil, the effect of the additive tends to decrease.

Moreover, the % $C_A$ of the base oil for use in the lubricating oil composition for the internal combustion engine of the invention is preferably not more than 2, further preferably not more than 1, further more preferably not more than 0.8, particularly preferably not more than 0.5, most preferably 0 (It should be noted that the % $C_A$, which is a calculated value, can be minus). With the % $C_A$ of more than 2, viscosity-temperature property, heat/oxidation stability and fuel saving property tend to decrease.

It should be noted that the % $C_P$ and the % $C_A$ herein refer to the percentage of the paraffin carbon number to the total carbon number and the percentage of the aromatic carbon number to the total carbon number, which are obtained by a method according to ASTM D 323.5-85 (n-d-M ring analysis), respectively.

Moreover, although the saturation fraction of the base oil for use in the lubricating oil composition for the internal combustion engine of the invention is not particularly limited as long as the kinematic viscosity at 100° C. meets the above conditions, it is preferably not less than 90 mass %, further preferably not less than 95 mass %, further more preferably not less than 99 mass %, based on the total amount of the base oil. Also, the ratio of the cyclic saturation fraction to the saturation fraction is preferably not more than 40 mass %, further preferably not more than 35 mass %, further more preferably not more than 30 mass %, particularly preferably not more than 25 mass %. Particularly, for the base oil (B), it is further preferably not more than 20 mass %. By meeting the above conditions for the saturation fraction of the base oil, viscosity-temperature property and heat/oxidation stability can improve. Also, when an additive is formulated to the base oil, the function of the additive can evolve at a higher standard, while stably retaining sufficient dissolution of the additive in the base oil. It should be noted that the saturation fraction herein is measured by a method described in ASTM D 2007-93.

Furthermore, according to the invention, the friction property of the base oil itself can be improved, and subsequently, improvement of the friction reducing effect and therefore improvement of the energy saving property can be achieved.

In the lubricating oil composition for the internal combustion engine of the invention, the synthetic oil usable in combination with a mineral oil includes poly-α-olefin or hydride thereof, isobutene oligomer or hydride thereof, isoparaffin, alkylbenzene, alkylnaphthalene and the like, and among them, poly-α-olefin is preferable. The poly-α-olefin typically includes an oligomer or cooligomer of α-olefin with a carbon number of 2 to 32, preferably 6 to 16 (1-octen oligomer, decene oligomer, ethylene-propylene oligomer, etc.) and hydrides thereof.

The lubricating oil composition for the internal combustion engine of the invention contains a calcium salicylate-based detergent (C) in 0.05 mass % to 0.5 mass % as a calcium amount based on the total amount of the composition.

The above calcium salicylate-based detergent (C) specifically includes a compound represented by the following general formula (1).

[Chem. 1]

(1)

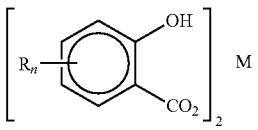

In the above general formula (1), R is preferable to be a linear or branched alkyl group with a carbon number of 10 to 30, preferably 14 to 30, more preferably not less than 20 and not more than 26. Also, M represents calcium, and n represents 1 to 4, preferably 1 to 2.

The above calcium salicylate-based detergent (C) can be produced by a publicly known method and the like, and is not particularly limited. For example, it can be obtained by subjecting an alkylsalicylic acid having a monoalkylsalicylic acid as the main component obtained by a method of alkylating phenol using an olefin with a carbon number of 10 to 30 such as a polymer or copolymer of ethylene, propylene, butene and the like, preferably a linear α-olefin such as an ethylene polymer, and carboxylating it with a carbon dioxide gas, a method of alkylating a salicylic acid using the olefin, preferably the linear α-olefin, or the like to a reaction with a metal base such as an oxide and hydroxide of alkali metal or alkali earth metal, conversion to an alkali metal salt such as a sodium salt and potassium salt, additionally substitution of an alkali metal salt with an alkali earth metal salt, and the like.

The above calcium salicylate-based detergent (C) for use in the invention is preferable to be a basic salt obtained by heating the alkali metal or alkali earth metal salicylate (neutral salt) obtained as above and an additional excessive alkali earth metal salt or alkali earth metal base (hydroxide or oxide of alkali earth metal) in the presence of water, or an overbasic salt obtained by reacting the above neutral salt with a base such as a hydroxide of alkali earth metal in the presence of a carbon dioxide gas, or boric acid or borate. It should be noted that in the case of the invention, the alkali earth metal described above means calcium.

In the lubricating oil composition for the internal combustion engine of the invention, the content of the calcium salicylate-based detergent (C) is not less than 0.05 mass %, preferably not less than 0.08 mass %, further preferably not less than 0.10 mass %, most preferably not less than 0.15 mass %, and also not more than 0.5 mass %, preferably not more than 0.3 mass %, further preferably not more than 0.25 mass % as a calcium element conversion amount based on the total amount of the composition. With the calcium conversion content of the calcium salicylate-based detergent (C) of less than 0.05 mass %, base number maintaining property and high temperature cleaning property as excellent as the invention cannot be exerted, while with the calcium conversion content of the calcium salicylate-based detergent (C) of more than 0.5 mass %, the sulfated ash in the composition increases, which is not preferable as a lubricating oil composition for an internal combustion engine.

In the lubricating oil composition for the internal combustion engine of the invention, the base number of the calcium salicylate-based detergent (C) is preferably 100 to 350 mg KOH/g. Moreover, the base number of the calcium salicylate-based detergent (C) is further preferably not less than 120 mg KOH/g, further more preferably not less than 150 mg KOH/g. Furthermore, the base number of the calcium salicylate-based detergent (C) is further preferably not more than 300 mg KOH/g, further more preferably not more than 250 mg KOH/g, particularly preferably not more than 200 mg KOH/g. In the lubricating oil composition for the internal combustion engine of the invention, one kind or two or more kinds selected from these can be used in combination. With the base number of the calcium salicylate-based detergent (C) of less than 100 mg KOH/g, neutralizing capability is not enough, while with that of more than 350 mg KOH/g stability as a lubricating oil composition deteriorates, and sufficient heat resistance property cannot be exerted. It should be noted that the base number herein refers to a base number measured by a perchloric acid method according to 7. of JIS K 2501 "Petroleum Products and Lubricants—Determination of Neutralization Number".

The lubricating oil composition for the internal combustion engine of the invention contains a calcium sulfonate-based detergent (D) in 0.002 mass % to 0.2 mass % as a calcium amount based on the total amount of the composition.

The above calcium sulfonate-based detergent (D) includes a calcium salt of an alkyl aromatic sulfonic acid obtained by sulfonating an alkyl aromatic compound with a molecular weight of 300 to 1500, preferably 400 to 700. Here, the alkyl aromatic sulfonic acid specifically includes a so-called petroleum sulfonic acid, synthetic sulfonic acid, and the like.

As the above petroleum sulfonic acid, generally, a sulfonated alkyl aromatic compound of a lubricating oil fraction of a mineral oil, a so-called mahogany acid produced as a byproduct during production of a white oil, or the like is used. Also, as the above synthetic sulfonic acid, for example, sulfonated alkylbenzene with a linear or branched alkyl group obtained by producing as a byproduct from an alkylbenzene production plant for a raw material of detergents or by alkylating an oligomer of olefin with a carbon number of 2 to 12 (ethylene, propylene, etc.) into benzene, sulfonated alkylnaphthalene such as dinonyl naphthalene, or the like is used. Moreover, although a sulfonating agent upon sulfonating these alkyl aromatic compounds is not particularly limited, normally a fuming sulfuric acid or sulfuric anhydride is used.

The base number of the calcium sulfonate-based detergent (D) for use in the lubricating oil composition for the internal combustion engine of the invention is preferable to be 5 to 150 mg KOH/g. Moreover, the base number of the calcium sulfonate-based detergent (D) is further preferably not less than 10 mg KOH/g, further more preferably not less than 15 mg KOH/g, most preferably not less than 20 mg KOH/g. Moreover, the base number of the calcium sulfonate-based detergent (D) is further preferably not more than 130 mg KOH/g, further more preferably not more than 100 mg KOH/g, particularly preferably not more than 50 mg KOH/g, most preferably not more than 30 mg KOH/g. A basic sulfonate with a base number of more than 150 mg KOH/g, which is overbased with a carbonate called overbasic, is not suitable for the invention of the subject application since the deposit increases at a high temperature. On the other hand, one with a base number of 5 mg KOH/g may not be a neutral salt, and there are possibilities that a sulfonic acid residue has adverse effects. Also, an overbasic sulfonate with a base number of more than 150 mg KOH/g does not show sufficient heat resistance property.

In the lubricating oil composition for the internal combustion engine of the invention, the content of the calcium sulfonate-based detergent (D) is not less than 0.002 mass %, preferably not less than 0.005 mass %, further preferably not less than 0.008 mass %, also not more than 0.2 mass %, preferably not more than 0.1 mass %, further preferably not more than 0.05 mass %, most preferably not more than 0.02 mass % as a calcium element conversion amount based on the total amount of the composition. With the calcium conversion content of the calcium sulfonate-based detergent (D) of less than 0.002 mass %, base number maintaining property and high temperature cleaning property as excellent as the invention cannot be exerted, while the calcium conversion content of the calcium sulfonate-based detergent (D) of more than 0.2 mass %, heat resistance property rather decreases.

In the lubricating oil composition for the internal combustion engine of the invention, the ratio (C/D) of the calcium salicylate-based detergent (C) to the calcium sulfonate-based detergent (D) is preferably not more than 200/1, more preferably not more than 100/1, also preferably not less than 2/1, more preferably not less than 10/1 as a calcium element ratio. With the ratio of the calcium salicylate-based detergent (C) of more than 200, the effect of the calcium sulfonate-based detergent (D) is lost, while with that of less than 2, the adverse effect of the calcium sulfonate-based detergent (D) on heat resistance property is concerned.

The lubricating oil composition for the internal combustion engine of the invention is preferable to further contain an organic molybdenum compound (E), in order to increase fuel saving performance and heat resistance property. The organic molybdenum compound (E) includes a complex of an organic molybdenum compound containing sulfur such as molybdenum dithiophosphate and molybdenum dithiocarbamate, a molybdenum compound [e.g., molybdenum oxide such as molybdenum dioxide and molybdenum trioxide, a molybdic acid such as an orthomolybdic acid, paramolybdic acid and molybdic acid (poly)sulfide, a molybdate such as a metal salt and ammonium salt of these molybdic acids, molybdenum sulfide such as molybdenum disulfide, molybdenum trisulfide, molybdenum pentasulfide and molybdenum polysulfide, molybdic acid sulfide, a metal salt or amine salt of molybdic acid sulfide, and molybdenum halide such as molybdenum chloride, etc.] with a sulfur containing organic compound [e.g., alkyl(thio)xantate, thiadiazole, mercaptothiadiazole, thiocarbonate, tetrahydrocarbyl thiuram disulfide, bis(di(thio)hydrocarbyl dithiophosphonate)disulfide, organic (poly)sulfide, sulfide ester, etc.] or other organic compound, a complex of a sulfur containing molybdenum compound such as the above molybdenum sulfides and molybdic acid sulfides with an alkenylsuccinimide, or the like.

As the above molybdenum dithiocarbamate, molybdenum sulfide diethyl dithiocarbamate, molybdenum sulfide dipropyl dithiocarbamate, molybdenum sulfide dibutyl dithiocarbamate, molybdenum sulfide dipentyl dithiocarbamate, molybdenum sulfide dihexyl dithiocarbamate, molybdenum sulfide dioctyl dithiocarbamate, molybdenum sulfide didecyl dithiocarbamate, molybdenum sulfide didodecyl dithiocarbamate, molybdenum sulfide di(butylphenyl)dithiocarbamate, molybdenum sulfide di(nonylphenyl)dithiocarbamate, oxymolybdenum sulfide diethyl dithiocarbamate, oxymnolybdenum sulfide dipropyl dithiocarbamate, oxymolybdenum sulfide dibutyl dithiocarbamate, oxymolybdenum sulfide dipentyl dithiocarbamate, oxymolybdenum sulfide dihexyl dithiocarbamate, oxymolybdenum sulfide dioctyl dithiocarbamate, oxymolybdenum sulfide didecyl dithiocarbamate, oxymolybdenum sulfide didodecyl dithiocarbamate, oxymolybdenum sulfide di(butylphenyl)dithiocarbamate, oxymolybdenum sulfide di(nonylphenyl)dithiocarbamate (an alkyl group may be linear or branched, and also the binding position of an alkyl group of an alkylphenyl group is optional), a mixture thereof, and the like can specifically be exemplified. It should be noted that as these molybdenum dithiocarbamates, a compound having a hydrocarbon group with a different carbon number and/or structure within a molecule can also be preferably used.

Moreover, as the above organic molybdenum compound (E), an organic molybdenum compound containing no sulfur as a constituent element can be used. The organic molybdenum compound containing no sulfur as a constituent element specifically includes a molybdenum-amine complex, a molybdenum-succinimide complex, a molybdenum salt of an organic acid, a molybdenum salt of alcohol, and the like, and among them, a molybdenum-amine complex, a molybdenum salt of an organic acid and a molybdenum salt of alcohol are preferable.

In the lubricating oil composition for the internal combustion engine of the invention, the content of the above organic molybdenum compound (E) is preferably not less than 0.02 mass %, further preferably not less than 0.03 mass %, further more preferably not less than 0.05 mass/%, particularly preferably not less than 0.06 mass %, also preferably not more than 0.15 mass %, more preferably not more than 0.12 mass %, particularly preferably not more than 0.10 mass % as a molybdenum element conversion based on the total amount of the composition. When the content of the organic molybdenum compound (E) as a molybdenum conversion is less than 0.02 mass %, fuel saving property becomes insufficient. On the other hand, when the content of the organic molybdenum compound (E) as a molybdenum conversion is more than 0.15 mass %, a fuel saving effect corresponding to the content cannot be obtained, which is economically irrational, and also heat resistance property as one of the purposes of the invention may become insufficient.

In the lubricating oil composition for the internal combustion engine of the invention, as the above organic molybdenum compound (E), molybdenum dithiocarbamate (MoDTC) is particularly preferable. Moreover, it is further preferable to use molybdenum dithiocarbamate and molybdenum amine in combination. When they are used in combination, the molybdenum dithiocarbamate/molybdenum amine ratio is preferably not more than 50/1, more preferably not more than 25/1, also preferably not less than 1/1, further preferably not less than 2/1, further more preferably not less than 5/1 as a molybdenum element ratio. With the molybdenum element conversion ratio of molybdenum dithiocarbamate to molybdenum amine of less than 1, sufficient fuel saving property cannot be ensured, while with that of more than 50, the effect of the molybdenum amine amount on heat resistance property cannot be observed.

In the lubricating oil composition for the internal combustion engine of the invention, a viscosity index improving agent can further be used. The viscosity index improving agent specifically includes poly(meth)acrylate, and a copolymer of (meth)acrylate as its monomer with styrene, polyolefin or a vinyl compound with an amine structure for dispersibility. As the other viscosity index improving agent, in addition to the viscosity index improving agent described above, a non-dispersed type or dispersed type ethylene-α-olefin copolymer or hydride thereof, polyisobutylene or hydride thereof, a styrene-diene hydrogenated copolymer, a styrene-maleic anhydride ester copolymer, polyalkylstyrene and the like can further be contained.

The content of the viscosity index improving agent in the lubricating oil composition for the internal combustion engine of the invention is preferably 0.01 to 20 mass %, further preferably 0.02 to 16 mass %, further more preferably 0.05 to 14 mass % based on the total amount of the composition. With the content of the viscosity index improving agent of less than 0.01 mass %, viscosity temperature property and low temperature viscosity property are liable to deteriorate, while with that of more than 20 mass %, viscosity temperature property and low temperature viscosity property are liable to deteriorate, and further product cost hugely increases.

To the lubricating oil composition of the invention, unless the purposes and effects of the invention are inhibited, a friction adjusting agent other than the organic molybdenum compound (E) may be added. Here, as the other friction adjusting agent, an optional compound which is normally used as a friction adjusting agent for lubricating oils is usable, and an ashless friction adjusting agent is included for example.

The above ashless friction adjusting agent includes, for example, an amine compound, fatty acid ester, fatty acid amide, alkyl urea, alkyl carbazide, alkyl hydrazide, fatty acid, fatty acid metal salt, aliphatic alcohol, aliphatic ether, and the like having at least one alkyl group or alkenyl group with a carbon number of 6 to 30, particularly linear alkyl group or linear alkenyl group with a carbon number of 6 to 30 within a molecule.

As the above amine compound, a linear or branched, preferably linear aliphatic monoamine with a carbon number of 6 to 30, a linear or branched, preferably linear aliphatic polyamine, an alkylene oxide added product of these aliphatic amines, a salt of these amine compounds with a phosphate ester or phosphite ester, a boric acid modified product of a phosphate (phosphite) ester salt of these amine compounds, and the like can be exemplified. The amine compounds described above also include a succinimide and the like as a reaction product with a polyamine, and they also include a product modified with a boron compound or phosphorous compound.

The content of the ashless friction adjusting agent other than the organic molybdenum compound (E) in the lubricating oil composition for the internal combustion engine of the invention is preferably not less than 0.01 mass %, further preferably not less than 0.1 mass %, further more preferably not less than 0.3 mass %, also preferably not more than 3 mass %, further preferably not more than 2 mass %, further more preferably not more than 1 mass % based on the total amount of the composition. With the content of the ashless friction adjusting agent of less than 0.01 mass %, the friction reducing effect by its addition tends to become insufficient, while with that of more than 3 mass %, the effect of an anti-wear additive and the like are easily impeded, or solubility of the additive tends to deteriorate. It should be noted that as the friction adjusting agent, the use of an ashless friction adjusting agent is more preferable.

In the lubricating oil composition for the internal combustion engine of the invention, in order to further improve its performance, an optional additive generally used in lubricating oils depending on its purpose can be contained. Such an additive can include, for example, an additive such as an ashless dispersant, anti-oxidizing agent, anti-wear agent (or extreme pressure agent), anti-corrosive agent, anti-rust agent, pour point depressing agent, anti-emulsifying agent, metal deactivating agent and anti-foaming agent.

The lubricating oil composition for the internal combustion engine of the invention is, particularly, preferable to contain an ashless dispersant (F). As the ashless dispersant (F), an optional ashless dispersant for use in lubricating oils can be used, and for example, a nitrogen containing compound having at least one linear or branched alkyl group or alkenyl group with a carbon number of 40 to 400, preferably 60 to 350 within a molecule or its derivative, a Mannich-based dispersant, a mono- or bis-succinimide (e.g. alkenylsuccinimide), a benzyl amine having at least one alkyl group or alkenyl group with a carbon number of 40 to 400 within a molecule, a polyamine having at least one alkyl group or alkenyl group with a carbon number of 40 to 400 within a molecule, a modified product thereof with a boron compound, carboxylic acid, phosphoric acid or the like, or the like is included. Upon the use, one kind or two or more kinds optionally selected from these can be formulated. Particularly in the invention, it is preferable to contain an alkenylsuccinimide.

A production method of the above succinimide is not particularly limited, and it can be obtained by, for example, reacting a compound having an alkyl group or alkenyl group with a carbon number of 40 to 400 with maleic anhydride at 100 to 200° C. to obtain an alkylsuccinic acid or alkenylsuccinic acid and reacting it with a polyamine. Here, as the polyamine, a diethylene triamine, triethylene tetramine, tetraethylene pentamine and pentaethylene hexamine can be exemplified.

The derivative of the nitrogen containing compound exemplified as the above ashless dispersant (F) includes, for example, a compound modified with a so-called oxygen containing organic compound by reacting the nitrogen containing compound described above with a monocarboxylic acid with a carbon number of 1 to 30 such as a fatty acid, a polycarboxylic acid with a carbon number of 2 to 30 such as an oxalic acid, phthalic acid, trimellitic acid and pyromellitic acid, or anhydride or ester compound thereof, alkylene oxide with a carbon number of 2 to 6, hydroxy(poly)oxyalkylene carbonate to partially or totally neutralize, or amidate a remaining amino group and/or imino group; a so-called boron modified compound formed by reacting the nitrogen containing compound described above with a boric acid to partially or totally neutralize, or amidate a remaining amino group and/or imino group; a so-called phosphoric acid modified compound formed by reacting the nitrogen containing compound described above with a phosphoric acid to partially or totally neutralize, or amidate a remaining amino group and/or imino group; a sulfur modified compound formed by reacting the nitrogen containing compound described above with a sulfur compound; and a modified compound formed by subjecting the nitrogen containing compound described above to two or more kinds of modifications selected from modification by an oxygen containing organic compound, boron modification, phosphoric acid modification and sulfur modification in combination. Among these derivatives, a boric acid modified compound of an alkenylsuccinimide, particularly a boric acid modified compound of a bis-type alkenylsuccinimide can further improve heat resistance property in combination with the base oil (A) described above.

The content ratio of the above ashless dispersant (F) in the lubricating oil composition for the internal combustion engine of the invention is normally 0.005 to 0.4 mass %, preferably 0.01 to 0.2 mass %, further preferably 0.01 to 0.1 mass %, particularly preferably 0.02 to 0.05 mass %, as a nitrogen amount based on the total amount of the composition. Moreover, as the ashless dispersant (F), it is preferable to mix a boron containing ashless dispersant with an ashless dispersant containing no boron to use. The mass ratio (B/N ratio) between the boron content and the nitrogen content is not particularly limited, but preferably 0.15 to 1.2, more preferably 0.5 to 1, particularly preferably 0.7 to 0.9. With a higher B/N ratio, it is easier to improve wear resistance property and seizure resistance property, while with that of more than 1.2, stability is concerned. Also, when a boron containing ashless dispersant is used, its content ratio is not particularly limited, but preferably 0.001 to 0.1 mass %, more preferably 0.005 to 0.05 mass %, particularly preferably 0.01 to 0.04 mass % as a boron amount based on the total amount of the composition.

As the ashless dispersant (F) in the lubricating oil composition for the internal combustion engine of the invention, it is most preferable to contain a boron containing ashless dispersant, particularly a bis-type boron containing succinimide-based ashless dispersant, with a boron content of preferably not less than 0.4 mass %, more preferably not less than 1.0 mass %, further preferably not less than 1.5 mass %, particularly preferably not less than 1.8 mass %. It should be noted that the boron containing ashless dispersant with a boron content of not less than 0.4 mass % herein may contain 10 to 90 mass %, preferably 30 to 70 mass % of, for example, a diluted oil such as a mineral oil and synthetic oil, and its boron content normally means a boron content in a state of containing a diluted oil.

The number average molecular weight (Mn) of the ashless dispersant (F) in the lubricating oil composition for the internal combustion engine of the invention is preferably not less than 2500, further preferably not less than 3000, further more preferably not less than 4000, most preferably not less than 5000, also preferably not more than 10000. With the number average molecular weight of the ashless dispersant of less than 2500, dispersibility may not be sufficient, while with the number average molecular weight of the ashless dispersant of more than 10000, the viscosity is too high and the flow property becomes insufficient, which causes the deposit increase.

The above anti-oxidizing agent includes an ashless anti-oxidizing agent such as phenol-based and amine-based anti-oxidizing agents, and a metal-based anti-oxidizing agent such as copper-based and molybdenum-based anti-oxidizing agents. Specifically, for example, the phenol-based ashless anti-oxidizing agent includes 4,4'-methylene bis(2,6-di-tert-butylphenol), 4,4'-bis(2,6-di-tert-butylphenol) and the like, and the amine-based ashless anti-oxidizing agent includes phenyl-α-naphthylamine, alkylphenyl-α-naphthylamine, dialkyldiphenylamine and the like.

As the above anti-wear agent (or extreme pressure agent), an optional anti-wear agent/extreme pressure agent for use in lubricating oils can be used. For example, a sulfur-based, phosphorous-based or sulfur-phosphorous-based extreme pressure agent and the like can be used, and specifically, phosphite esters, thiophosphite esters, dithiophosphite esters, trithiophosphite esters, phosphate esters, thiophosphate esters, dithiophosphate esters, trithiophosphate esters, amine salts thereof, metal salts thereof, derivatives thereof, dithiocarbamates, zinc dithiocarbamates, molybdenum dithiocarbamates, disulfides, polysulfides, sulfurized olefins, sulfurized greases, and the like are included. Among them, zinc alkyldithiophosphate is preferable. An alkyl group of the zinc alkyldithiophosphate has a carbon number of preferably 3 to 12, further preferably 3 to 8. Moreover, while alkyl groups have the primary and the secondary, it is preferable to use a mixture of the secondary and the primary in the invention. Although the secondary is more effective as an anti-wear agent, since it is poorer in oxidation stability than the primary, a mixture is preferable in the invention. While the primary and the secondary of alkyl groups are due to the structure of alcohol upon synthesis, a mixture upon synthesis may be used, or zinc dialkyldithiophosphate synthesized only with the primary and zinc dialkyldithiophosphate synthesized only with the secondary may be mixed and used. Furthermore, although the mixing ratio between the primary and the secondary is not limited, the molar number of the primary is preferable to be not less than 30% and not more than 70%. It is because this range is the best balance between wear resistance property and heat resistance property. Also, the addition amount of the anti-wear agent (or extreme pressure agent) is preferably 0.05 to 0.12 mass %, more preferably not more than 0.1 mass %, as a phosphorous element amount based on the total amount of the lubricating oil composition for the internal combustion engine.

The above anti-corrosive agent includes, for example, a benzotriazole-based, tolyltriazole-based, thiadiazole-based or imidazole-based compound, and the like.

The above anti-rust agent includes, for example, petroleum sulfonate, alkylbenzene sulfonate, dinonylnaphthalene sulfonate, alkenylsuccinate ester, polyhydric alcohol ester, and the like.

As the above pour point depressing agent, for example, a polymethacrylate-based polymer compatible with a lubricant base oil for use, and the like can be used.

The above anti-emulsifying agent includes, for example, a polyalkylene glycol-based nonionic surfactant such as a polyoxyethylene alkylether, polyoxyethylene alkylphenylether and polyoxyethylene alkylnaphthylether, and the like.

The above metal deactivating agent includes, for example, an imidazoline or pyrimidine derivative, alkylthiadiazole, mercaptobenzothiazole, benzotriazole or a derivative thereof, 1,3,4-thiadiazole polysulfide, 1,3,4-thiadiazolyl-2,5-bisdialkyldithiocarbamate, 2-(alkyldithio)benzoimidazole, β-(o-carboxybenzylthio)propionitrile, and the like.

The above anti-foaming agent includes, for example, a silicone oil with a kinematic viscosity at 25° C. of 1000 to 100,000 $mm^2/s$, an alkenylsuccinic acid derivative, esters of polyhydroxy aliphatic alcohol and a long chain fatty acid, methyl salicylate and o-hydroxybenzyl alcohol, and the like.

When these additives are contained in the lubricating oil composition for the internal combustion engine of the invention, the content of each is preferably 0.001 to 10 mass % based on the total amount of the composition.

The kinematic viscosity at 100° C. of the lubricating oil composition for the internal combustion engine of the invention is preferably 4.5 to 9.3 $mm^2/s$, further preferably not more than 8.5 $mm^2/s$, further more preferably not more than 7.8 $mm^2/s$, particularly preferably not more than 7.0 $mm^2/s$, most preferably not more than 6.5 $mm^2/s$, and also, further preferably not less than 5.6 $mm^2/s$. The kinematic viscosity at 100° C. herein refers to a kinematic viscosity at 100° C. regulated in ASTM D-445. With a kinematic viscosity at 100° C. of less than 4.5 $mm^2/s$, it is liable to lead to the lack of lubricity, while with that of more than 9.3 $mm^2/s$, it is liable that necessary low temperature viscosity and sufficient fuel saving performance may not be obtained.

The viscosity index of the lubricating oil composition for the internal combustion engine of the invention is preferably within a range of 180 to 280, further preferably not less than 200, further more preferably not less than 220, particularly preferably not less than 250. When the viscosity index of the lubricating oil composition of the invention is less than 180, it is liable to become difficult to improve fuel saving property while maintaining the HTHS viscosity at 150° C., and it is further liable to become difficult to reduce the low temperature viscosity at −35° C. Also, when the viscosity index of the lubricating oil composition of the invention is more than 280, evaporation property is liable to deteriorate, and further a defect due to the lack of solubility of an additive and compatibility with a sealing material is liable to occur.

The HTHS viscosity at 100° C. of the lubricating oil composition for the internal combustion engine of the invention is preferably not more than 5.5 mPa·s, further preferably not more than 5.0 mPa·s, particularly preferably not more than 4.5 mPa·s, and also, preferably not less than 3.5 mPa·s, further preferably not less than 3.7 mPa·s, particularly preferably not less than 4.0 mPa·s. The HTHS viscosity at 100° C. herein refers to a high temperature high shear viscosity at 100° C. regulated in ASTM D4683. With an HTHS viscosity at 100° C. of less than 3.5 mPa·s, it is liable to lead to the lack of lubricity, while with that of more than 5.5 mPa·s, it is liable that necessary low temperature viscosity and sufficient fuel saving performance may not be obtained.

The HTHS viscosity at 150° C. of the lubricating oil composition for the internal combustion engine of the invention is preferably not more than 2.9 mPa·s, further preferably not more than 2.6 mPa·s, particularly preferably not more than 2.3 mPa·s, and also, preferably not less than 1.7 mPa·s, more preferably not less than 2.0 mPa·s. The HTHS viscosity at 150° C. herein refers to a high temperature high shear viscosity at 150° C. regulated in ASTM D4683. With a HTHS viscosity at 150° C. of less than 1.7 mPa·s, it is liable to lead to the lack of lubricity, while with that of more than 2.9 mPa·s, it is liable that necessary low temperature viscosity and sufficient fuel saving performance may not be obtained.

EXAMPLES

Although the invention will be further specifically described based on Examples and Comparative Examples below, the invention is not limited to the following examples.

Examples 1 to 2, Comparative Examples 1 to 9

As shown in Table 1, lubricating oil compositions of the invention (Examples 1 to 2) and lubricating oil compositions for comparison (Comparative Examples 1 to 9) were prepared. It should be noted that in Table 1, the amount of a base oil is the content ratio in the base oil, while the amount of an additive is the content based on the total amount of the composition. These compositions were subjected to a panel coking test according to FED. TEST METHOD STD. No. 791B to evaluate heat resistance property at a high temperature. The test conditions are as shown below.

<Panel Coking Test Conditions>

Test oil amount: 300 mL

Panel temperature: 300° C.

Test oil temperature: 100° C.

Splash rotational speed: 1000 rpm

Splash On/Off=15 s/45 s

Test time: 3 hours

TABLE 1

| | | | Ex. 1 | Ex. 2 | Ex. 3 | Comp. Ex. 1 | Comp. Ex. 2 | Comp. Ex. 3 | Comp. Ex. 4 |
|---|---|---|---|---|---|---|---|---|---|
| Base Oil Composition | Base Oil 1 *1 | mass % | 25 | 25 | 25 | 50 | 50 | — | — |
| | Base Oil 2 *2 | mass % | 75 | — | — | 50 | — | 100 | — |
| | Base Oil 3 *3 | mass % | — | 75 | 75 | — | 50 | — | 100 |
| | Base Oil 4 *4 | mass % | — | — | — | — | — | — | — |
| Additives | Ca Salicylate *5 (Ca Amount Based on Total Amount of Composition) | mass % | 2.9 (0.18) | 2.9 (0.18) | 1.5 (0.09) | 2.9 (0.18) | 2.9 (0.18) | 2.9 (0.18) | 2.9 (0.18) |
| | Ca Sulfonate *6 (Ca Amount Based on Total Amount of Composition) | mass % | 0.4 (0.009) | 0.4 (0.009) | 0.4 (0.009) | 0.4 (0.009) | 0.4 (0.009) | 0.4 (0.009) | 0.4 (0.009) |
| | Organic Molybdenum Compound *7 (Mo Amount Based on Total Amount of Composition) | mass % | 0.7 (0.07) | 0.07 (0.07) | 0.7 (0.07) | 0.7 (0.07) | 0.7 (0.07) | 0.7 (0.07) | 0.7 (0.07) |
| | Viscosty Index Improving Agent *8 | mass % | 8.2 | 8.5 | 8.5 | 8.5 | 8.8 | 8.0 | 8.0 |
| | Other Additivies *9 | mass % | 6.5 | 6.5 | 6.5 | 6.5 | 6.5 | 6.5 | 6.5 |
| Mixed Base Oil Viscosity | Kinematic Viscosity at 40° C. | $mm^2/s$ | 16.5 | 15.3 | 16.5 | 15.4 | 14.6 | 17.8 | 16.0 |
| | Kinematic Viscosity at 100° C. | $mm^2/s$ | 3.8 | 3.7 | 3.8 | 3.6 | 3.6 | 4.1 | 3.9 |
| | Viscosity Index | | 127 | 135 | 127 | 122 | 127 | 132 | 143 |
| Ca Salicylate/Ca Sulfonate Ratio | | Ca Ratio | 19/1 | 19/1 | 10/1 | 19/1 | 19/1 | 19/1 | 19/1 |
| Deposit Amount in Panel Coking Test | | mg | 109.6 | 94.8 | 102.4 | 187.8 | 139.8 | 110.1 | 78.0 |

| | | | Comp. Ex. 5 | Comp. Ex. 6 | Comp. Ex. 7 | Comp. Ex. 8 | Comp. Ex. 9 |
|---|---|---|---|---|---|---|---|
| Base Oil Composition | Base Oil 1 *1 | mass % | 50 | 100 | 75 | 50 | 25 |
| | Base Oil 2 *2 | mass % | 45 | — | 25 | 50 | 75 |
| | Base Oil 3 *3 | mass % | — | — | — | — | — |
| | Base Oil 4 *4 | mass % | 5 | — | — | — | — |
| Additives | Ca Salicylate *5 (Ca Amount Based on Total Amount of Composition) | mass % | 2.9 (0.18) | 2.9 (0.18) | 2.9 (0.18) | 3.1 (0.19) | 3.1 (0.19) |
| | Ca Sulfonate *6 (Ca Amount Based on Total Amount of Composition) | mass % | 0.4 (0.009) | 0.4 (0.009) | 0.4 (0.009) | — | — |
| | Organic Molybdenum Compound *7 (Mo Amount Based on Total Amount of Composition) | mass % | 0.7 (0.07) | 0.7 (0.07) | 0.7 (0.07) | 0.7 (0.07) | 0.7 (0.07) |
| | Viscosty Index Improving Agent *8 | mass % | 8.5 | 9.4 | 9.0 | 8.5 | 8.2 |
| | Other Additivies *9 | mass % | 6.5 | 6.5 | 6.5 | 6.5 | 6.5 |
| Mixed Base Oil Viscosity | Kinematic Viscosity at 40° C. | $mm^2/s$ | 15.9 | 13.5 | 14.4 | 15.4 | 16.5 |
| | Kinematic Viscosity at 100° C. | $mm^2/s$ | 3.7 | 3.3 | 3.5 | 3.6 | 3.8 |
| | Viscosity Index | | 122 | 111 | 117 | 122 | 127 |

TABLE 1-continued

| | | | | | | |
|---|---|---|---|---|---|---|
| Ca Salicylate/Ca Sulfonate Ratio | Ca Ratio | 19/1 | 19/1 | 19/1 | — | — |
| Deposit Amount in Panel Coking Test | mg | 154.0 | 281.3 | 185.3 | 222.5 | 195.6 |

*1 to 4 Base Oils 1 to 4: characteristics are shown in Table 2.
*5 Ca Salicylate: base number = 170 mg KOH/g, Ca content = 6.2 mass %
*6 Ca Sulfonate: base number = 22 mg KOH/g, Ca content = 2.35 mass %
*7 Organic Molybdenum Compound: molybdenum dithiocarbamate (MoDTC), Mo content = 10 mass %
*8 Viscosity Index Improving Agent: polymethacrylate
*9 Other Additives: details are shown in Table 3.

TABLE 2

| | | | Base Oil 1 | Base Oil 2 | Base Oil 3 | Base Oil 4 |
|---|---|---|---|---|---|---|
| Kinematic Viscosity | 40° C. | $mm^2/s$ | 13.1 | 17.9 | 15.8 | 37.8 |
| | 100° C. | $mm^2/s$ | 3.2 | 4.1 | 3.9 | 6.7 |
| Viscosity Index | | | 109 | 131 | 143 | 133 |
| Sulfur Content | | mass ppm | <1 | <1 | <1 | <1 |
| Nitrogen Content | | mass ppm | <1 | <1 | <1 | <1 |
| n-d-M Ring Analysis | | $C_A$ % | 0.0 | −0.4 | −0.3 | 0.0 |
| | | $C_N$ % | 24.9 | 13.0 | 7.4 | 21.2 |
| | | $C_P$ % | 75.1 | 87.3 | 92.9 | 78.8 |

TABLE 3

| Other Additives | Addition Amount (mass %) |
|---|---|
| Non Boron-Based Succinimide (N Content = 0.61 mass %, Mn = 9200, Mw = 13800) | 2.5 |
| Boron Containing Succinimide (N Content = 1.5 mass %, B Content = 0.5 mass %, Mn = 5850, Mw = 7420) | 1 |
| Zinc Dialkyldithiophosphate (Primary/Secondary Ratio = 0.5, Phosphorous in Oil Amount = 0.08 mass %) | 1 |
| Mo Amine (Mo Content = 4.5 mass %) | 0.15 |
| Diphenyl Amine | 0.6 |
| Dithiocarbamate | 0.4 |
| Phenol-Based Ashless Anti-oxidizing Agent | 0.35 |
| Diluted Oil and Others | 0.51 |

From the Examples in Table 1, it is clear that when the base oil (A) is contained in 25 mass %, a similar deposit performance to the base oil (B) in 100 mass % is shown, and also the base oil viscosity decreases, so fuel saving property improves. On the other hand, when the base oil (A) is contained in not less than 50 mass %, it is clear that while the base oil viscosity decreases and fuel saving property improves, the deposit amount remarkably increases.

INDUSTRIAL APPLICABILITY

The lubricating oil composition for the internal combustion engine of the invention, which exerts excellent heat resistance property and excellent fuel saving property, has a high industrial value. Thus, the lubricating oil composition for the internal combustion engine of the invention is a fuel saving lubricating oil composition for an internal combustion engine, which satisfies both fuel saving property and heat resistance property at the same time, and can preferably be used as a fuel saving lubricating oil composition not only for a petrol engine, but also for a diesel internal combustion engine, and the like.

Moreover, the lubricating oil composition for the internal combustion engine of the invention can also preferably be used in a petrol internal combustion engine, a diesel internal combustion engine, a gas internal combustion engine for a two wheeled vehicle, a four wheeled vehicle, power generation, cogeneration, and the like. Furthermore, it can be used not only in these various internal combustion engines using a fuel with a sulfur content of not more than 50 ppm by mass, but it is also useful in various internal combustion engines for ships and outboard engines.

The invention claimed is:

1. A lubricating oil composition for an internal combustion engine containing:

a mixed base oil (AB) comprising a mixture of a base oil (A) being a mineral oil and/or a synthetic oil with a kinematic viscosity at 100° C. of not more than 3.5 $mm^2/s$ and a base oil (B) being a mineral oil and/or a synthetic oil with a kinematic viscosity at 100° C. of more than 3.5 $mm^2/s$ and less than 4.5 $mm^2/s$, wherein the ratio of the base oil (A) to the entire base oil is not more than 40 mass %;

a calcium salicylate-based detergent (C) in 0.05 mass % to 0.5 mass % as a calcium amount based on the total amount of the composition, and;

a calcium sulfonate-based detergent (D) in 0.002 mass % to 0.2 mass % as a calcium amount based on the total amount of the composition, wherein the base number of the calcium sulfonate-based detergent (D) is 5 to 150 mg KOH/g.

2. A lubricating oil composition for an internal combustion engine according to claim 1, wherein the kinematic viscosity at 100° C. of the mixed base oil (AB) comprising the base oil (A) and the base oil (B) is 3.5 to 3.9 $mm^2/s$.

3. A lubricating oil composition for an internal combustion engine according to claim 1, wherein the base number of the calcium salicylate-based detergent (C) is 100 to 350 mg KOH/g.

4. A lubricating oil composition for an internal combustion engine according to claim 1, further containing an organic molybdenum compound (E) in not less than 0.02 mass % as a molybdenum amount based on the total amount of the composition.

5. A lubricating oil composition for an internal combustion engine according to claim 2, wherein the base number of the calcium salicylate-based detergent (C) is 100 to 350 mg KOH/g.

6. A lubricating oil composition for an internal combustion engine according to claim 2, further containing an organic molybdenum compound (E) in not less than 0.02 mass % as a molybdenum amount based on the total amount of the composition.

7. A lubricating oil composition for an internal combustion engine according to claim 3, further containing an organic molybdenum compound (E) in not less than 0.02 mass % as a molybdenum amount based on the total amount of the composition.

8. A lubricating oil composition for an internal combustion engine according to claim 5, further containing an organic molybdenum compound (E) in not less than 0.02 mass % as a molybdenum amount based on the total amount of the composition.

9. A lubricating oil composition for an internal combustion engine according to claim 1, wherein base oil (A) has a kinematic viscosity at 100° C. of from 1.5 to 3.5 $nm^2/s$, and base oil (B) has a kinematic viscosity at 100° C. of not less than 3.8 $nm^2/s$ and less than 4.5 $nm^2/s$.

10. A lubricating oil composition for an internal combustion engine according to claim 1, wherein base oil (A) has a kinematic viscosity at 100° C. of from 2.0 to 3.5 $nm^2/s$, and base oil (B) has kinematic viscosity at 100° C. of not less than 3.8 $nm^2/s$ and less than 4.5 $nm^2/s$.

11. A lubricating oil composition for an internal combustion engine according to claim 1, wherein base oil (A) has a kinematic viscosity at 100° C. of from 2.5 to 3.5 $nm^2/s$, and base oil (B) has a kinematic viscosity at 100° C. of not less than 3.8 $nm^2/s$ and not more than 4.3 $nm^2/s$.

12. A lubricating oil composition for an internal combustion engine according to claim 1, wherein base oil (A) has a kinematic viscosity at 100° C. of from 3.0 to 3.5 $nm^2/s$, and base oil (B) has a kinematic viscosity at 100° C. of not less than 3.8 $nm^2/s$ and not more than 4.3 $nm^2/s$.

* * * * *